United States Patent [19]

Spinner

[11] Patent Number: 4,786,883

[45] Date of Patent: Nov. 22, 1988

[54] TRANSFORMATION DEVICE FOR CONNECTING WAVEGUIDES

[76] Inventor: Georg Spinner, Am Eichberg 12, 8152 Fledkirchen-Westerham, Fed. Rep. of Germany

[21] Appl. No.: 96,078

[22] Filed: Sep. 11, 1987

[30] Foreign Application Priority Data

Sep. 19, 1986 [DE] Fed. Rep. of Germany ..... 3631981

[51] Int. Cl.[4] ..... H01P 1/16; H01P 5/08

[52] U.S. Cl. ..... 333/21 R; 333/34; 333/254

[58] Field of Search ..... 333/21 R, 33–35, 333/254, 248

[56] References Cited

U.S. PATENT DOCUMENTS 3,500,258 3/1970 Nagelberg ..... 333/21 R 3,686,595 8/1972 Spinner ..... 333/21 R X 3,851,281 11/1974 Hanfling ..... 333/33

4,540,959 9/1985 Saad ..... 333/21 R

*Primary Examiner*—Paul Gensler

*Attorney, Agent, or Firm*—Henry M. Feiereisen

[57] ABSTRACT

A transformation device for connecting waveguides of different cross section includes a waveguide element which is provided with at least two successive transforming sections and has a rotationally symmetrical recess extending in axial direction over all transforming sections. Inserted in the recess along a respective portion thereof are a plurality of insulating rigs so that one of said transforming sections adjoining the connection plane with one of the waveguides is defined by said recess while subsequent transforming sections are defined by the insulating rings of corresponding varying inner diameter.

14 Claims, 5 Drawing Sheets

TRANSFORMATION DEVICE FOR CONNECTING WAVEGUIDES

FIELD OF THE INVENTION

The present invention refers to a transformation device for connecting waveguides of different cross section, in particular elliptic waveguides with rectangular waveguides.

BACKGROUND OF THE INVENTION

In recent years elliptic waveguides, especially corrugated elliptic waveguides have gained importance and application because of their flexibility. In order to connect such elliptic waveguides in a reflection-free manner with conventionally used rectangular waveguides, transformation devices are required which are generally employed for connecting waveguides of varying cross section in a reflection-free manner or at least only at low reflection.

It is known to make transformation devices by galvanoplastic methods or through precision casting. These manufacturing methods, have the drawback, that the very narrow tolerances required to achieve a low reflection coefficient over a broad band width cannot be attained so that cumbersome and complicated after-treatments are required and in addition adjusting pins must be provided and individually calibrated.

From the German patent DE-PS No. 19 48 156, there is known a transformation device for connecting a rectangular waveguide with an elliptic waveguide which can be produced through cutting treatment. This method is less expensive and more precise than the previously mentioned manufacturing methods. Such a transformation device has the cross section of the rectangular waveguide to be connected whereby the broader sides of the rectangular cross section have a stepped recess over a length of lambda/4 which is rotationally symmetrical to the axis of the transformation device.

The German patent DE-PS No. 20 17 042 describes a transformation device which includes a waveguide element defined by several transforming sections successively arranged in axial direction and with a length of lambda/4 for increasing the band width. The diameter of the rotationally symmetric recesses in the broader sides decreases step-by-step in direction from the connection plane with the elliptic waveguide to the connection plane with the rectangular waveguide.

Such a transformation device has the drawback that the individual stepped recesses have to be bored at an extreme precision and, further, it is difficult to provide within the individual transforming sections recesses or continuous transitions from section to section (as it is known per se from the Swiss patent CH-PS 551 086). A further drawback is the fact that transformation devices with a plurality of stepped recesses are of considerable axial length.

SUMMARY OF THE INVENTION

It is thus an object of the present invention to provide an improved transformation device obviating the aforestated drawbacks.

This object and others which will become apparent hereinafter are attained in accordance with the present invention by providing a waveguide element which has a length corresponding to at least two transforming sections and includes a rotationally symmetrical recess extending over all transforming sections, and is provided with one or more insulating rings successively inserted in the recess along a respective portion thereof so that one of the transforming sections adjoining the connection plane with one of the waveguides is defined by the recess while subsequent transforming sections are defined by the insulating rings of correspondingly varying inner diameter. These insulating rings can be made of low-loss insulating material of varying dielectric constant, and preferably are part of a one-piece insert of insulating material which is defined by various inner diameters to define the subsequent transforming sections.

Through the provision of such insulating rings, the manufacture of a transformation device according to the invention can be obtained by simple and cost-saving methods and yet allows greater freedom when it comes to the design of the inner cross section of the transforming sections. There is only the requirement to provide a single rotationally symmetrical recess e.g. in the broadsides of a waveguide element of rectangular cross section while the insulating rings defining the various transforming sections can easily and cost-efficiently be produced through injection molding as their tolerances may exceed the tolerances of the transforming sections of a transformation device made completely of metal by about the (relative) dielectric constant $\epsilon$. A further advantage of the present invention resides in the fact that the transformation device can be made with shorter dimensions because the wavelength lambda in the transforming sections which are defined by the insulating rings is smaller proportionate to $1/\sqrt{\epsilon}$ so that upon unchanged dimensioning of the axial length of each transforming section of about lambda/4 the mechanical length of each transforming section is reduced.

According to the teachings of the present invention, in the portion of the recess which defines the first transforming section and thus is of greatest diameter, a further insulating ring may be inserted which has a smaller inner diameter than the subsequent insulating ring. This feature provides an especially favorable matching to the adjoining waveguide e.g. elliptic waveguide, and thus an especially low reflection coefficient.

An especially favorable matching and in addition a sealed flanged connection are attained when according to a further feature of the invention the first transforming section is provided in the adjoining plane to the elliptic waveguide with an elliptic groove in which a gasket is inserted. The gasket has a inner contour which is selected in correspondence to the capacitive component to be generated in this area.

For obtaining a separation of waveguide systems with varying internal pressure, the transformation device according to the invention is provided with a pressure plate between the elliptic gasket and the first succeeding cylindrical insulating ring. Preferably, the pressure plate is made of mica or the like and may simultaneously be designed a transformation capacitance.

A further shortening of the transformation device may be achieved by providing the recess over the entire length of the transformation device form its one connection plane to its other connection plane.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
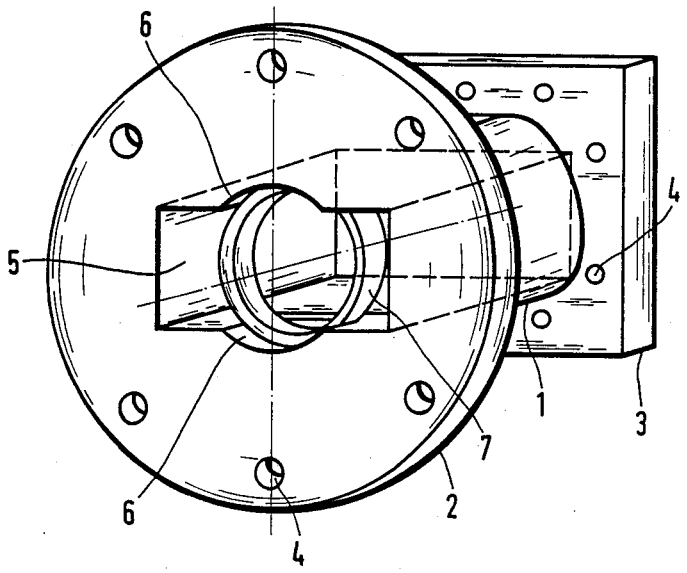
FIG. 1 is a perspective view of a first embodiment of a transformation device according to the the invention.

Referring firstly to FIG. 1, there is shown a perspective view of first embodiment of a transformation device for connecting an elliptic waveguide with a rectangular waveguide and generally designated by reference numeral 1. In order to facilitate illustration of the present invention, the waveguides to be connected are omitted. The transformation device 1 comprises a waveguide element 5 of rectangular inner cross section which corresponds to the cross section of the rectangular waveguide. At one end, the waveguide element 5 includes an annular flange 2 with circumferential tap holes 4 for connection with the elliptic waveguide while at the other end, the waveguide element 5 includes a rectangular flange 3 which is also provided with circumferential tap holes 4 for connection with the rectangular waveguide.

Arranged in the broader sides of the waveguide element 5 is a rotationally symmetrical recess 6 which is preferably in the shape of a segment of a circle and extends centrally in the broadsides of the waveguide element 5. As shown in FIG. 1, the recess 6 extends from the flange 2 in direction toward the flange 3 and has a diameter corresponding essentially to the widest diameter of the elliptic waveguide in the connection plane. The depth i.e. axial length of the recess 6 corresponds essentially to the length of two transforming sections of which the first one is defined by the recess 6 itself while the second one is defined by an insulating ring 7 of low-loss dielectric which is inserted along a respective portion of the recess 6. The insulating ring 7 has a wavelength lambda which is smaller than the wavelength of a corresponding wave in the air or in an air-filled metallic waveguide so that the axial length of the insulating ring 7 is smaller than the axial length of the first transforming section defined by the recess 6.

The embodiment of the transformation device 1 as illustrated in FIG. 1 is especially suitable for connecting waveguides whose axial ratio varies only to a limited degree and/or with limited demand on the band width and the reflection coefficient.

Figure 2:
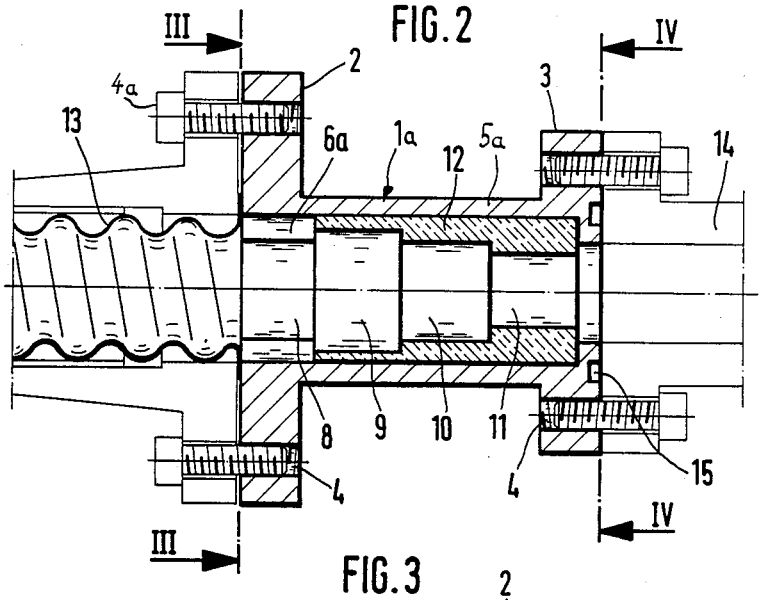
FIG. 2 is a longitudinal section of a second embodiment of a transformation device according to the invention.
Figure 4:
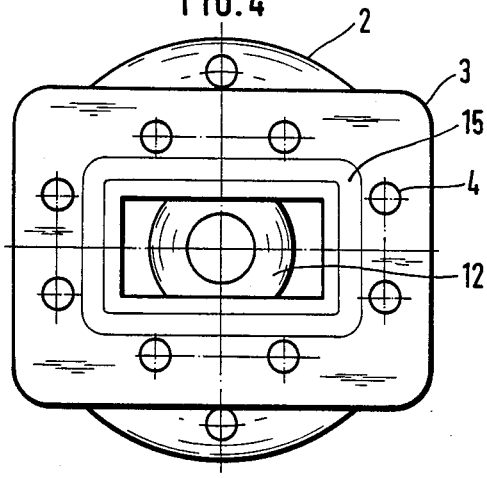
FIG. 4 is another frontal view of the transformation device according to FIG. 2 taken along the line IV—IV in FIG. 2.

Turning now to FIG. 2, there is shown a longitudinal section of second embodiment of a transformation device 1*a* which includes a waveguide element 5*a* connected with its annular flange 2 to a corrugated elliptic waveguide 13 by means of aligned tap holes 4 and suitable screws 4*a*, and with its rectangular flange 3 in like manner to a rectangular waveguide 14. At the junction to the waveguide 14, the waveguide element 5*a* is provided with a groove 15—as shown in FIGS. 2 and 4—for receiving a suitable sealing.

Figure 3:
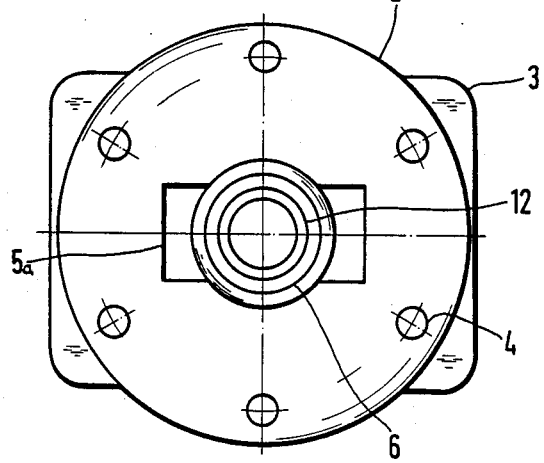
FIG. 3 is one frontal view of the transformation device according to FIG. 2 taken along the line III—III in FIG. 2.

The transformation device 1*a* is provided with a total of four transforming sections and includes along the broader sides of the waveguide element 5*a* the continuous axial recess 6, the first portion of which defines the first transforming section 8 extending from the connection plane to the waveguide 13 at a length of approximately lambda/4. Inserted into the remaining portion of the recess 6 is an annular insert 12 of insulating material which is made of one piece. The insert 12 has an inner diameter which in direction from the waveguide 13 to the waveguide 14 is reduced step-by-step to define the transforming sections 9, 10, 11 with an axial length of approximately lambda/4. FIG. 3 shows a frontal view of the transformation device as viewed from the elliptic waveguide 13 while FIG. 4 shows a frontal view as viewed from the rectangular waveguide 14.

Figure 5:
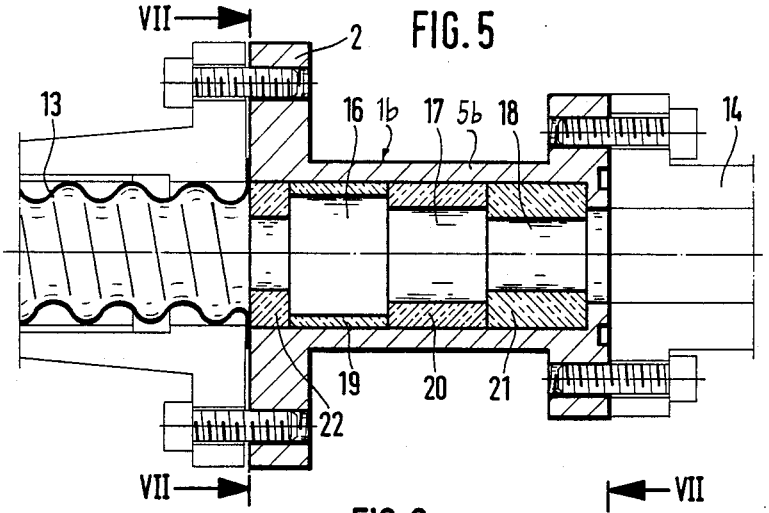
FIG. 5 is a longitudinal section of a third embodiment of a transformation device according to the invention.

FIG. 5 illustrates a longitudinal section of a third embodiment of a transformation device 1*b* which is similar to the transformation device 1*a* as shown in FIG. 2. The essential distinction therebetween resides in the design of the insulating insert. While in the embodiment of FIG. 2, the insert 12 was made of one piece to define the transforming sections 9, 10, 11, the waveguide element 5*b* of the transformation device 1*b* is provided with transforming sections 16, 17, 18 which are defined by individual and separate insulating rings 19, 20, 21 of successively reduced inner diameter in direction from the waveguide 13 to the waveguide 14. Suitably, the individual insulating rings 19, 20, 21 may be made of dielectric with varying dielectric constant.

In order to provide an improved matching of the first transforming section, the respective portion of the recess 6 contains an additional insulating ring 22 with an inner diameter which is smaller than the inner diameter of the subsequent insulating ring 19. Preferably, the inner diameter of the insulating ring 22 corresponds approximately to the inner diameter of the insulating ring 21.

Figure 6:
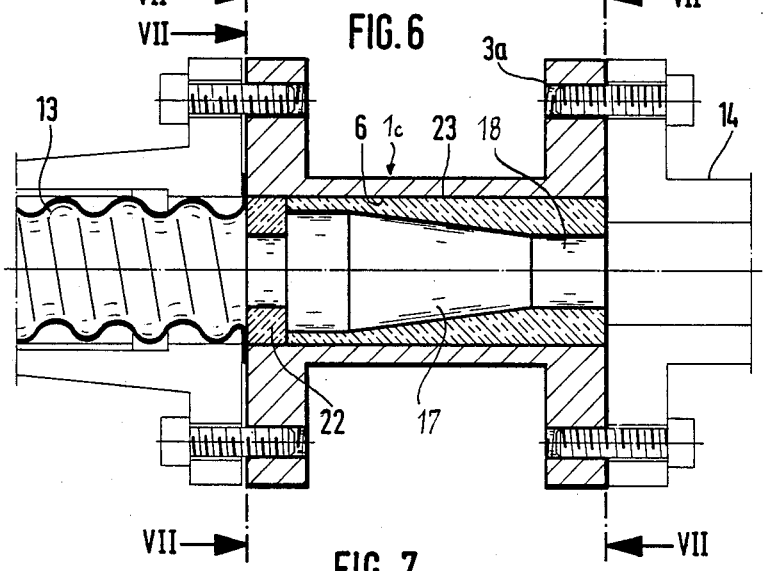
FIG. 6 is a longitudinal section of a fourth embodiment of a transformation device according to the invention.

FIG. 6 is a longitudinal section of a transformation device 1*c* which is similar to the transformation device 1*b* except that the separate insulating rings are substituted by an insulating insert 23 which is made of one piece to define the transforming sections 16, 17, 18 whereby the transforming section 17 is defined by a tapered transition between the sections 16 and 18. The inner diameter of insulating ring 22 corresponds to the inner diameter of the insert 23 along the transforming section 18. Moreover, in contrast to the axial length, the recess 6 and thus the insert 23 extend up to the connection plane of the flange 3a of the transformation device 1c with the rectangular waveguide 14. It will readily be recognized that in this case, the groove 15 with the contained sealing may be omitted.

Figure 7:
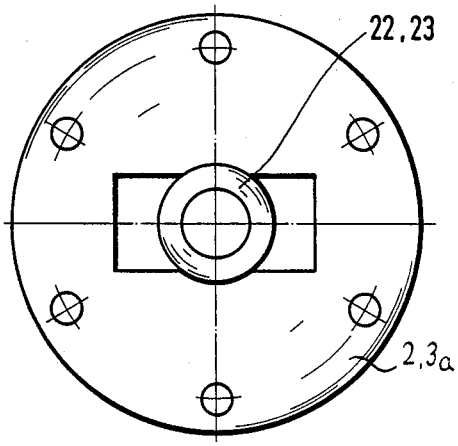
FIG. 7 is a frontal view of the transformation device according to FIG. 5 and the transformation device according to FIG. 6, taken along the line VII—VII as respectively indicated in FIGS. 5 and 6.

In FIG. 6, the annular flange 3a connecting the transformation device 1c to the rectangular waveguide 14 corresponds in its dimensions to the flange 2. It will thus be appreciated that the frontal view as illustrated in FIG. 7 covers the view in the direction from the elliptic waveguide in the embodiments according to FIGS. 5 and 6 as well as in the direction from the rectangular waveguide 14 in the embodiment according to FIG. 6.

Figure 8:
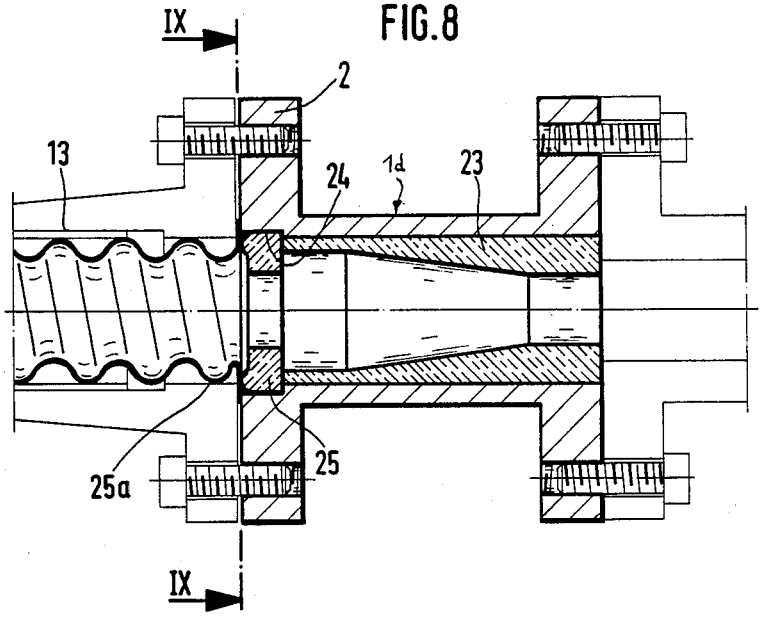
FIG. 8 is a longitudinal section of a fifth embodiment of a transformation device according to the invention.
Figure 9:
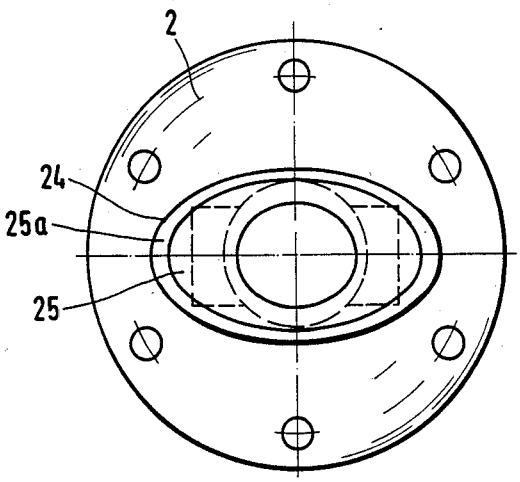
FIG. 9 is a frontal view of the transformation device according to FIG. 8 taken along the line IX—IX in FIG. 8.

Referring now to FIG. 8, there is shown a longitudinal section of a fifth embodiment of a transformation device 1d which differs from the transformation device 1c according to FIG. 6 in that the connecting flange 2 is provided at its side facing the elliptic waveguide 13 with an additional elliptic recess 24 which contains a lip seal in form of an elastic profiled gasket 25 with a lip 25a projecting outwardly to cooperate with the flanged end of the corrugated elliptic waveguide 13 for sealing the respective connection plane toward the outside. As shown in the frontal view of FIG. 9, the gasket 25 has an internal contour which is also slightly elliptic and the material and contour are selected in such a manner so as to generate the capacitive component for attaining a suitable matching in this area.

Figure 10:
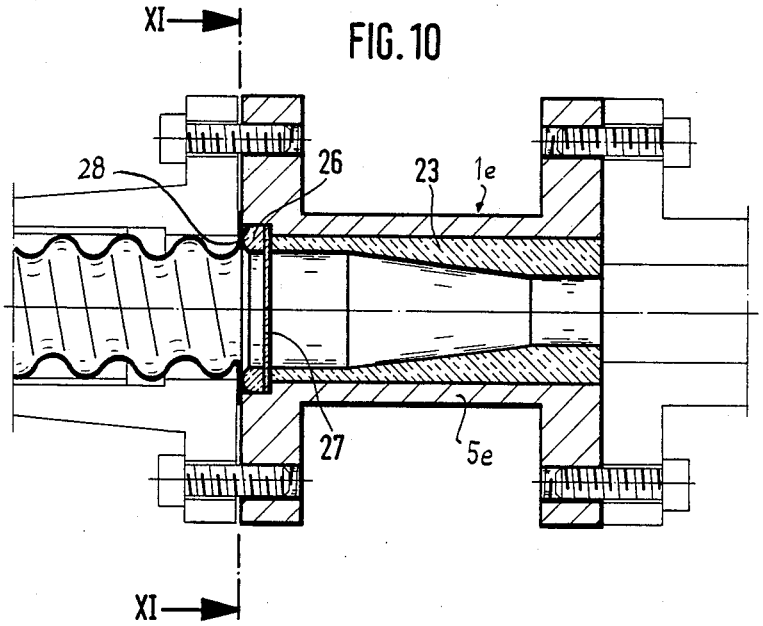
FIG. 10 is a longitudinal section of a sixth embodiment of a transformation device according to the invention.
Figure 11:
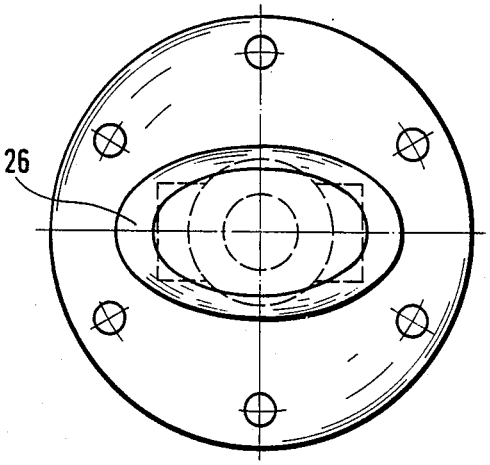
FIG. 11 is a frontal view of the transformation device according to FIG. 10 taken along the line XI—XI in FIG. 10.

In FIG. 10, a sixth embodiment of a transformation device 1e is shown in longitudinal section which is especially suitable for connecting waveguide systems of varying internal pressure. The transformation device 1e includes a waveguide element 5e which at its end facing the elliptic waveguide 13 is provided with an elliptic recess 28 in which a gasket 26 is inserted. Extending between the gasket 26 and the insulating insert 23 is a pressure plate or window 27 which is made of mica, Trolitul or the like. Through selection of a suitable dielectric and a suitable width, the pressure plate 27 can be provided simultaneously as transformation capacitance.

It will be appreciated that although the present invention is described in connection with joining elliptic waveguides with rectangular waveguides, it should not be limited thereto; rather the present invention can be used e.g. also for connecting circular waveguides with rectangular waveguides or with elliptic waveguides.

While the invention has been illustrated and described as embodied in a Transformation Device for Connecting Waveguides, it is not intended to be limited to the details shown since various modifications and structural changes may be made without departing in any way from the spirit of the present invention.

What is claimed as new and desired to be protected by Letters Patent is set forth in the appended claims:

1. A transformation device for connecting waveguides of different cross section, comprising:

a waveguide element defining an axis and having an axial length corresponding to at least two transforming sections, said waveguide element including two recesses extending symmetrical to each other in axial direction over the entire axial length of said transforming sections of said waveguide element, and insulating means including insulating rings of varying inner diameter, said insulating rings being successively inserted in said recesses in such a manner that one of said transforming sections adjoining the connection plane with one of the waveguides is defined by said recesses while subsequent transforming sections are defined by said insulating rings.

2. A transformation device as defined in claim 1 wherein said insulating rings are made of low-loss insulating material of different dielectric constant.

3. A transformation device as defined in claim 1, and further comprising an insulating ring inserted in said recesses defining said first transforming section and having an inner diameter smaller than the succeeding insulating ring.

4. A transformation device as defined in claim 1 wherein said recesses extend over the entire axial length of said waveguide element from its one connection plane to its other connection plane.

5. A transformation device as defined in claim 1 wherein said waveguide element has an inner cross section corresponding to the waveguide with the smaller cross sectional dimensions.

6. A transformation device as defined in claim 1 wherein said transforming sections have an axial length of about lambda/4.

7. A transformation device as defined in claim 1 wherein said recesses define an inner diameter essentially corresponding to the waveguide with the greater cross sectional dimensions.

8. A transformation device as defined in claim 1 wherein said insulating rings are part of a one-piece insert of insulating material.

9. a transformation device as defined in claim 8 wherein said insert includes a transforming section defined by a tapered insulating ring for providing a transition between adjoining insulating rings.

10. A transformation device as defined in claim 1 with one of said waveguides to be connected being of elliptic cross section, wherein said first transforming section includes an elliptic groove at the junction plane with the elliptic waveguide, and a sealing ring inserted in said groove and having an internal contour corresponding to the capacitive component to be generated in this area.

11. A transformation device as defined in claim 10, and further comprising a pressure plate between said elliptic sealing ring and said insulating means.

12. A transformation device as defined in claim 11 wherein said pressure plate is made of mica.

13. A transformation device as defined in claim 11 wherein said pressure plate is made of polystyrene.

14. A transformation device as defined in claim 11 wherein said pressure plate has a dielectric and dimensions adapted for simultaneous use of said pressure plate as transformation capacitance.

* * * * *